US007044333B2

(12) United States Patent
Johns et al.

(10) Patent No.: US 7,044,333 B2
(45) Date of Patent: May 16, 2006

(54) TOOTHPASTE TUBE

(75) Inventors: Jennifer Johns, Milltown, NJ (US); David Chesley, Duxbury, MA (US); Eric Cunningham, Malden, MA (US)

(73) Assignee: Church & Dwight Co., Inc., Princeton, NJ (US)

( * ) Notice: Subject to any disclaimer, the term of this patent is extended or adjusted under 35 U.S.C. 154(b) by 273 days.

(21) Appl. No.: 10/762,893

(22) Filed: Jan. 22, 2004

(65) Prior Publication Data

US 2005/0161470 A1 Jul. 28, 2005

(51) Int. Cl.
*B65D 35/00* (2006.01)

(52) U.S. Cl. ..... 222/92; 222/94; 222/95; 222/107

(58) Field of Classification Search ..... 222/92, 222/94–95, 107, 215, 206, 105; 383/123–125, 383/906

See application file for complete search history.

(56) References Cited

U.S. PATENT DOCUMENTS

| | | | | |
|---|---|---|---|---|
| 1,972,344 | A * | 9/1934 | Jackson | 222/494 |
| 3,290,422 | A | 12/1966 | Michel | 264/259 |
| 3,506,157 | A | 4/1970 | Dukess | 222/94 |
| 4,090,541 | A * | 5/1978 | Cammarata et al. | 604/408 |
| 4,126,249 | A * | 11/1978 | Wood | 222/92 |
| 4,394,936 | A * | 7/1983 | Shavit | 222/107 |
| 4,493,439 | A * | 1/1985 | Ledewitz | 222/94 |
| 4,964,538 | A * | 10/1990 | Nimmey et al. | 222/92 |
| 5,076,464 | A | 12/1991 | Simon | 220/530 |
| 5,244,120 | A | 9/1993 | O'Meara | 222/94 |
| 5,269,441 | A | 12/1993 | O'Meara | 222/94 |
| 5,511,697 | A * | 4/1996 | Gruenbacher et al. | 222/107 |
| 5,628,429 | A | 5/1997 | Usen et al. | 222/1 |
| 5,800,653 | A | 9/1998 | Keller | 156/203 |
| RE36,035 | E | 1/1999 | Usen et al. | 222/1 |
| 5,860,565 | A | 1/1999 | Winston et al. | 222/1 |
| 5,900,086 | A | 5/1999 | Keller | 156/69 |
| 6,210,621 | B1 | 4/2001 | Usen et al. | 264/263 |
| 6,227,837 | B1 | 5/2001 | Keller et al. | 425/112 |
| 6,302,300 | B1 * | 10/2001 | Bosch | 222/107 |
| 6,358,454 | B1 | 3/2002 | Scheifele | 264/249 |
| 6,419,117 | B1 * | 7/2002 | Bosch | 222/1 |
| 6,551,543 | B1 | 4/2003 | Keller et al. | 264/478 |
| 6,568,305 | B1 | 5/2003 | Keller | 83/13 |
| 6,763,975 | B1 * | 7/2004 | Lesher | 222/94 |
| 2003/0222099 | A1 | 12/2003 | Keller | 222/94 |
| 2004/0026822 | A1 | 2/2004 | Keller | 264/248 |

FOREIGN PATENT DOCUMENTS

| | | |
|---|---|---|
| AU | 749729 | 7/2002 |

* cited by examiner

*Primary Examiner*—Frederick C. Nicolas
(74) *Attorney, Agent, or Firm*—Stephen B. Shear

(57) ABSTRACT

The present invention relates to plural compartment assemblies in which materials are stored in at least two separate compartments until the compartments are opened for use. More particularly, the invention relates to a dispensing tube whereby the utilization of a novel insert, a conventional dispensing tube can be divided into separate and discrete compartments at a low capital cost. The resulting dispensing assembly provides for dispensing more than one material from the same tube and even more particularly co-dispensing predetermined proportions of incompatible materials simultaneously and effectively.

21 Claims, 5 Drawing Sheets

TOOTHPASTE TUBE

FIELD OF THE INVENTION

The present invention relates to plural compartment assemblies in which materials are stored in at least two separate compartments. More particularly, the invention relates to dispensing means whereby with the utilization of a novel insert assembly, a conventional dispensing tube can be divided into separate and discrete compartments at a low cost. The resulting dispensing assembly provides for dispensing more than one material from the same tube and even more particularly co-dispense predetermined proportions of incompatible materials simultaneously and effectively.

BACKGROUND OF THE INVENTION

There are many products on the market today and many more waiting to be marketed which require the separation of components thereof due to the reactivity of the components, but must or, desirably, be dispensed simultaneously.

Some of the dual-dispensed products on the market today are peroxide toothpastes, hair coloring, epoxy adhesives, and the like. Many of these products require costly dispensers and fabricating and packaging equipment to produce dispensing means which deliver the separate components simultaneously. Besides the high cost, most of the dual-dispensers available today require a change in the target consumers' normal use habits with the product. These restrictions keep many products, that can bring major benefits to consumers but require dual-dispensing, from the market.

Products consisting of two flowable components such as pastes, gels, or liquids which must be stored separately are desirably packaged in containers having two compartments. Tubular bodies having chordal partitions are useful in providing two-compartment containers for two-component products which must have predetermined proportions of their components mixed at the time or point of use.

A number of longitudinally partitioned tubular bodies and dispensing containers having chordal partitions have been disclosed in the art. For instance, U.S. Pat. No. 3,290,422, issued Dec. 6, 1966 to Michel, discloses a method of producing a dispensing container by injection molding a head fitment and a longitudinally extending partition onto and inside of, respectively, a tubular body. Tubular containers having asymmetrically disposed chordal partitions are disclosed in U.S. Pat. No. 3,506,157, issued Apr. 14, 1970 to Dukess.

U.S. Pat. No. 5,076,464, issued Dec. 31, 1991 to Simon discloses a deformable tubular container which includes at least one longitudinal corrugated partition-forming wall which defines distinct compartments and which lends itself to a flattened seal at the end of the tube body, Here too, however, the body and wall are produced by injection molding in a mold and the wall is permanently molded to the body. U.S. Pat. Nos. 5,244,120 and 5,269,411, issued to O'Meara on Sep. 14, 1993 and Dec. 31, 1993, respectively, are similar in the scope of disclosure to the above earlier patent.

There are many cleaning, drug and personal products which are marketed today in single dispensing packages which could be dramatically improved if an inexpensive dual dispensing device were available. For example, products containing oxidizing agents, reducing agents, solvents, or materials with high or low pH's can be improved aesthetically by separating the flavor, fragrance or other components that normally would not withstand shelf life.

Many of the dually-dispensed products which are currently on the market and those which are not yet on the market can be dispensed from a tube rather than more costly dispensing means. A tube is a dispensing device that is readily available, familiar to most consumers, is comparatively less expensive and does not require elaborate filling equipment. If commercially available tubes could be easily and cheaply converted into dual-dispensing devices, it would be a great advantage to those either currently marketing or planning to market dually-dispensed products.

U.S. Re Pat. Nos. 36,035; 5,860,565; and 6,210,621, issued to Winston et al., disclose an inexpensive partition that is die cut and method of inserting the partition into a commercially available tube on the product filling line thereby dividing the tube volume into two distinct chambers before filling by the addition of each of two materials. By the addition of the partition, a conventional dispensing tube can be divided into separate and distinct compartments for dispensing more than one material from the same tube and, advantageously, can co-dispense incompatible materials simultaneously and at a low cost.

By using commercially available tubes there is no need to interfere with the tube manufacturing process, speed of production or cost, and, advantageously, the later addition of the partition, possibly during the product filling operation, to form the co-dispensing unit, costs far less, is more readily available in the size and form needed than existing molded codispensing units, and does not require a change in the consumers' use habits. To the consumer the dual-chambered tube looks and operates the same as a tube with a single compartment.

While the tubes of the above Winston et al. patents have been used successfully in the commercial market, in particular, for dispensing toothpaste, improvements can still be made. For one, during use, the partition can shift from a central location within the tube, causing an uneven distribution of the separated components. In some circumstances the uneven distribution of the components from the tube disadvantageously affects product quality during use.

SUMMARY OF THE INVENTION

The partition insert of the present invention, once installed into the tube, seals against the walls of the tube by folded flaps formed in the material. The partition insert fits within a collar insert, itself press fit within the shoulder of the tube head. The center or spine of the partition insert extends up through the tube neck. In this way the insert remains in place and divides the internal volume of the tube in half so that each half can be filled with separate materials. After filling the two compartments and sealing the bottom of the tube, each product can be dispensed simultaneously but without contact until the product leaves the tube.

In accordance with the present invention, one embodiment thereof relates to a substantially planar partition-forming member suitable for insertion into a squeezable cylindrical tube so as to form a partition and two separate and discrete compartments within the tube. The tube has a dispensing end comprised of a tube head having a shoulder and a neck terminating as a dispensing orifice and adapted to receive a closing cap and an open filling end into which the partition-forming member is inserted prior to filling. The partition-forming member has a configuration such that when inserted into the tube;

(i) the end of the partition-forming member corresponding to the dispensing end of the tube is substantially equal to the inner diameter of the neck and extends into the neck, (ii) the adjacent portion thereto conforms to the shape of the tube shoulder and fits within respective slots contained in a collar insert placed adjacent to and within the head of the tube and is juxtaposed thereto, (iii) the mid portion of the partition extends within the tube and has a width corresponding to at least one half the inner-circumference of the tube; and (iv) the terminal end of the partition-forming member corresponding to the filling end of the tube has a width very slightly less or substantially equal to one half the inner-circumference of said tube.

The partition-forming member or divider insert is folded along each longitudinal side at a distance from the edge thereof such that when fully inserted into the tube the partition-forming member folds along the folds thereby providing a spine between the folds and two flaps adjacent thereto. The partition-forming member is comprised of a material sufficiently resilient such that such member tends to revert to its original planar configuration thereby causing pressure of the flaps against the inner surface of the tube and providing a seal along the longitudinal edge with the inner surface of the tube. This partition can be spot welded or completely welded to the tube sleeve.

In another embodiment of the present invention, a squeezable dual compartment dispensing tube assembly is provided comprising a tubular container body, a tube head, having a shoulder and a neck terminating as a dispensing orifice and adapted to receive a closing cap, and wherein the tube body includes a filling end opposite the tube head and which is sealed after contents are placed in the tube compartments. The tubular container body has positioned therein a collar insert which fits within the tube head and is juxtaposed to the shoulder of the tube head. The collar insert includes a neck portion that fits within the tube head and does not obstruct the opening in the tube head. A substantially planar partition is inserted into the tube body and provides two adjacent compartments defined by a common wall segment and a pair of outer arcuate walls. The planar insert has a configuration generally conforming to that of the tube if flattened and comprising an end portion which is substantially equal to the inner diameter of the neck and which extends into the neck, an adjacent shoulder portion conforming to the inside shape of the tube shoulder, a mid-portion extending axially within the tube and having a width of at least about one half the inner circumference of the tube, and a terminal end positioned within the filling end of the tube and having a width substantially equal to one half the inner-circumference of said tube. The planar insert has folds along each longitudinal side to provide a spine between the folds and a flap at either side of the folds, wherein the insert can be folded generally into a "Z" shape. The planar insert is comprised of a material sufficiently resilient such that the divider insert tends to revert to its original planar configuration thereby causing pressure of the flaps against the inner arcuate tube walls thereby providing a pressure seal along the longitudinal edges with the surface of said arcuate walls. The configuration into which the insert folds, advantageously, provides that, when the tube is filled with product(s), such product (s) exert pressure against the surfaces of the flaps so as to force the flaps against the inner surface of the tube and improve the seal of the flaps against such tube inner surface wall. The partition insert is held in place by the collar insert, which includes two sets of opposing slots in the neck and shoulder portions of the collar insert to receive the neck and shoulder portions of the partition.

BRIEF DESCRIPTION OF THE DRAWINGS

While the specification concludes with claims particularly pointing out and distinctly claiming the subject matter regarding as forming the present invention, it is believed the invention will be better understood from the following description taken in connection with the accompanying drawings in which:

DETAILED DESCRIPTION

The present invention relates to a method of converting a standard commercially available tube into a novel co- or dual-dispensing tube by the insertion of an inexpensive divider insert and collar insert before the filling of the two individual components. This divider insert once installed in the tube results in a novel co-dispensing means which will maintain the individual integrity of the two separate components until they are dispensed side by side in the proper proportion by the normal action of squeezing the tube.

The present invention contemplates the use of the three major types of squeezable tubes commercially available and which are suitable for dispensing product for consumer and professional use. They may be classified as plastic, preferably thermoplastic tubes fabricated from a mono-layer of sheet material, tubes fabricated from a sheet or foil of metal, preferably aluminum, or tubes fabricated from one or more sheets of the above materials which are laminated into a single sheet.

The insert described by this invention will work in all three tube types, i.e., laminated, plastic or aluminum, converting each into a dual-dispensing tube. The insert material used for each different tube type, is inexpensive to produce and can be of a different base material or coating according to the tube into which it will be inserted. Allowance must be made, however, for proper sealing of the insert inside the tube so as not to interfere with the normal sealing or crimping of the tube after product addition. Thus, the insert can be made from polycoated board, polyethylene sheet, laminated board or any other inexpensive material that can be formed, preferably be die cut, and able to heat seal or mechanically crimp to commercially available tubes.

Figure 1:
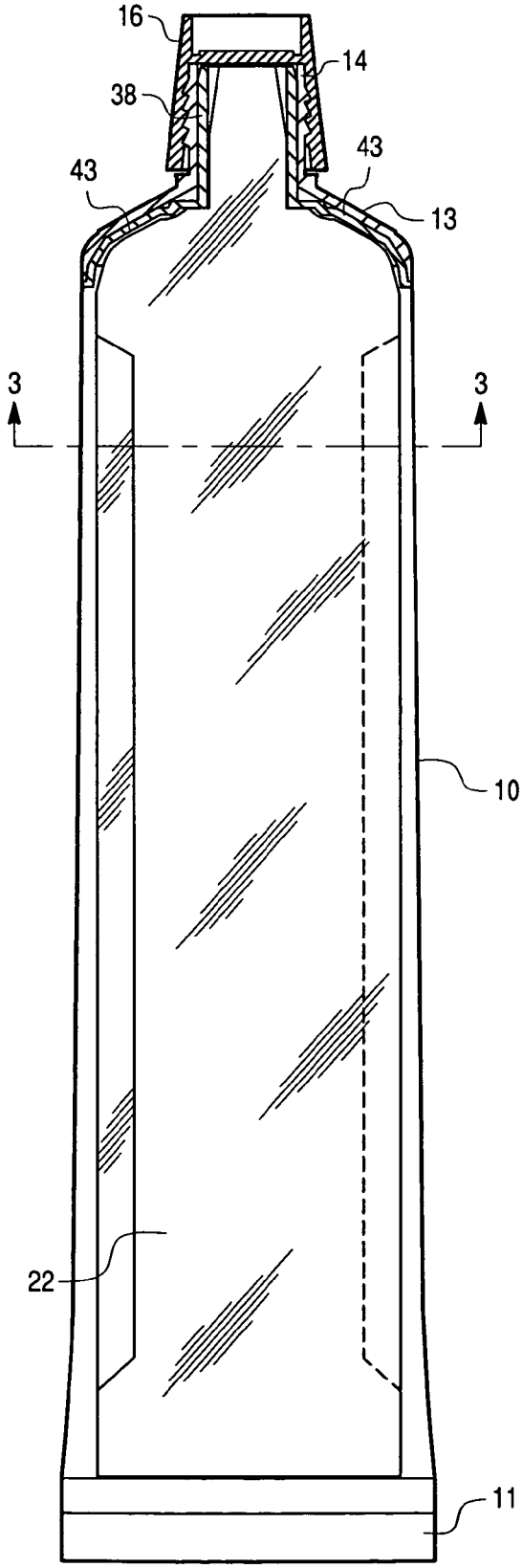
FIG. 1 is a vertical front elevation, partly in cross-section, of the dual-chambered dispenser of the present invention showing the partition-forming insert and collar insert.
Figure 2:
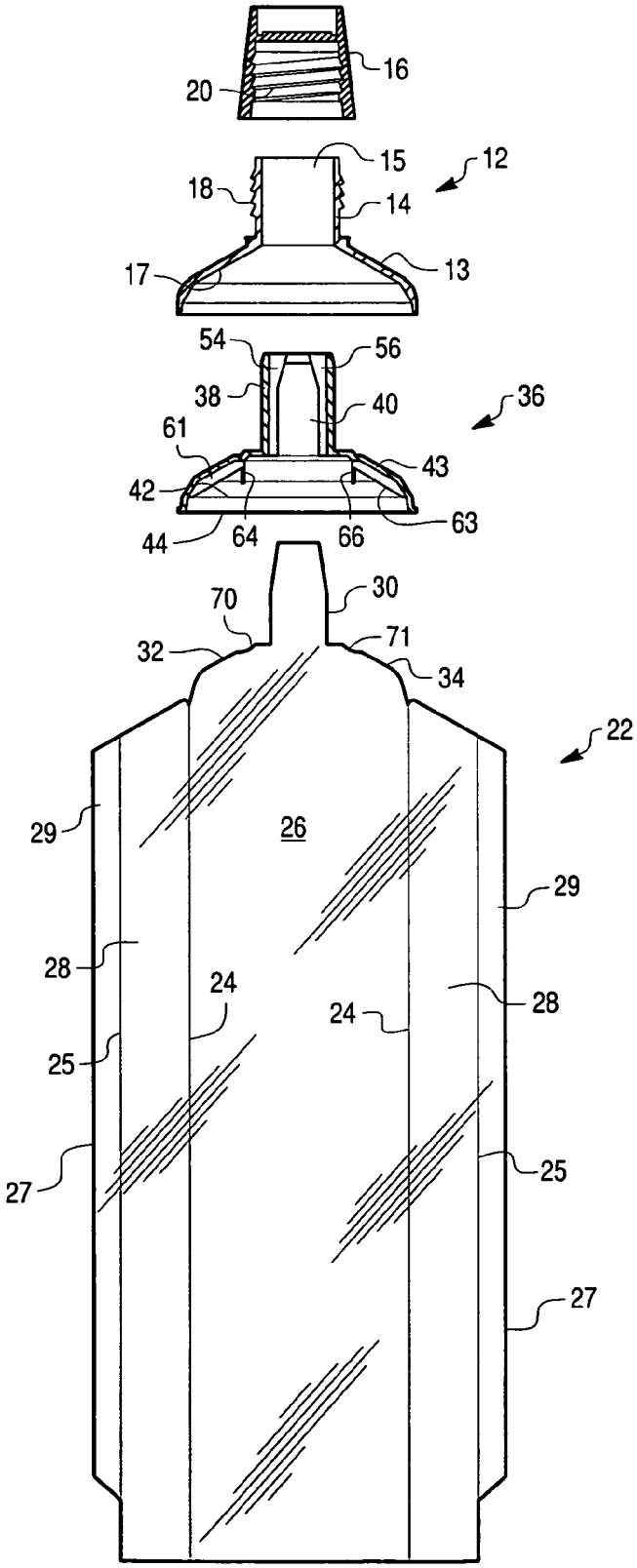
FIG. 2 is an exploded view, partly in cross-section, of the partition-forming insert and the securing means for the insert, including tube collar insert, tube head, and cap.
Figure 7:
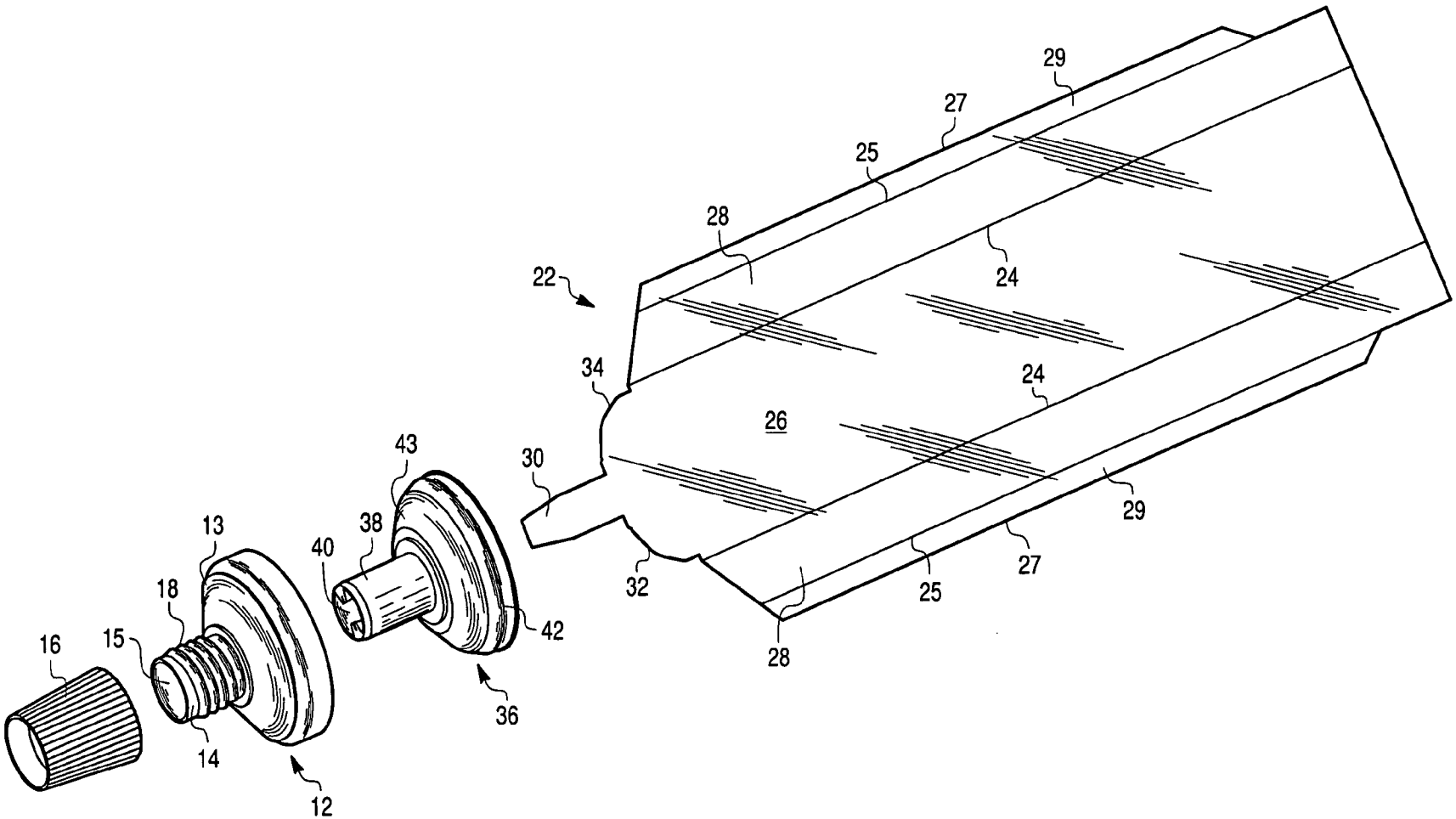
FIG. 7 is an exploded perspective view of the partition, collar insert, tube head, and cap.

The dual-chambered dispenser of the present invention is best viewed in FIGS. 1, 2, and 7 of the drawings.

The dispensing tube illustrated in FIGS. 1 and 2 comprises a tubular body generally designated 10, to one end of which is integrally united a tube head 12 containing collar 13 and threaded tube neck 14 adapted to receive a screw cap 16. The tube head 12 may be of any desired configuration and may be united to the body 10 in any desirable manner. Preferably, tube head 12 is of a thermoplastic material and is formed by molding and then fused to the body 10 in any acceptable manner known in the art. Tube head 12 is hollow, containing a passage 15 through neck 14 which terminates in an orifice from which the contents of tube 10 are dispensed. The outer periphery of the neck 14 is molded to form screw threads 18. Threads 18 match threads 20 placed along the inner circumference of cap 16 so as to allow cap 16 to be removed from neck 14 for dispensing the contents within tube 10 or to be tightened onto neck 14 to seal the contents within tube 10.

The tube body 10 may be of single or of laminated construction comprising several distinct layers bonded together. Generally, the body is formed from a flat web or blank which has been fabricated in a preliminary operation, an example of which is one wherein one or more thermoplastic films are extruded directly onto and bonded to opposite sides of an endless intermediate substrate. By way of illustration and not limitation, tube body 10 can be made up of an inner thermoplastic layer, an outer thermoplastic layer and an intermediate barrier layer of metallic foil, e.g., aluminum, all coextensively bonded together. Additional layers may be used, including intermediate layers of paper and/or special bonding thermoplastic adhesives formulated to provide good adherence of the thermoplastic layers to the foil layer.

Tubes of this type customarily are formed and attached to the tube head and capped by the tube manufacturer and shipped to the packer with the bottom or filling end of the tube open. After being filled through the bottom end with a product, the tube is sealed with a transverse bottom end seal 11.

The present invention is predicated on the use of an insert 22 which can be readily inserted into the tube 10 on the tube assembly line thereby dividing the tube 10 into two distinct chambers 21 and 23 (see FIG. 5) before filling. In one embodiment a collar insert 36 and divider insert 22 are assembled and then, in a separate step, the assembled collar insert and divider insert are slid into the center of a mandrel and a tube 10 is then positioned over the mandrel completing the assembly.

Reference to FIGS. 2 and 7 of the drawings illustrates the basic configuration of insert 22. The drawings also illustrate the basic configuration in FIG. 3 of the installed insert 22 as it would appear from just below the shoulder of an unsealed tube 10.

The insert 22 can be made from a polymer coated board, e.g., paper or cardboard, from plastic sheet material, e.g., thermoplastic polymeric materials such as polyethylene, from laminated boards, or from laminates of boards and polymeric sheet materials or from any other inexpensive material that can be formed and can be heat sealed or mechanically crimped to provide sealed closure 11 to commercially available tubes.

The insert material must be thick enough to withstand insertion without folding, buckling or crimping, yet be flexible enough to change form when the lower portion of the tube is flattened and sealed. The inserts can be formed to fit any commercially available tube size.

While the divider inserts can be formed by a plurality of methods including the relatively costly method of molding, the inserts are preferably die cut. Thus, while the present invention provides for any method known in the art to form the divider inserts, the description herein shall refer to die cutting as the means of fabricating the inserts 22. Since die cutting merely involves the cost of a die and not the cost of molds, inserts can be made available to fit all the major tube sizes without a large investment.

Referring again to FIGS. 1, 2, and 7, an insert 22 which, as preferred, is die cut with the width of the bottom thereof corresponding as nearly as possible to the internal width of the seal 11 with the tube 10. Scores, folds, or creases 24 are provided, e.g., embossed, longitudinally along both sides and near the edges of insert 22 such that the distance between the folds 24 would be less than the diameter of the tube 10. This area or space between the folds 24 is referred to herein as the spine 26 and the two areas extending outwardly from the folds 24 to the outer ends of the insert 22 are referred to as the sealing flaps 28. The scores 24 are formed so the sealing flaps 28 can be folded in opposite directions. For example the right side flap would fold upwards and if folded completely would fold onto the front of the spine and the left side flap would fold downwards and if folded completely would fold onto the back of the spine. When inserted into the tube 10 the flaps 28 and the spine 26 generally conform to an "Z" shape. This is illustrated in the bottom view of FIG. 3.

The flaps 28 may vary in width from the top to the bottom of the insert 22, including that area below the shoulder area, but must maintain a consistent or constant width for the spine 26. Increasing the overall width of the insert 22 results in wider flaps which are desirable to maintain or improve flap-to-wall interaction in the sealed tube and as closely as possible to the flattened sealed end. While the mid-section may be greater than one half the internal circumference of the tube, the total width of the flaps 28 plus the spine 26 cannot exceed one half the internal circumference of the tube 10 at the flattened sealed end 11. The width of the spine 26 may range from about 50.0% to about 99.0% of the diameter of the tube 10 when measured substantially above its flattened end, and is, preferably about 80.0% to 95.0% of the diameter. These dimensions provide adequate clearance for insertion of insert 22 into tube 10 and also optimum folding angles of the flaps so as to provide the greatest pressure exerted against the wall of the tube 10.

The scoring, creasing, or folding of the material from which insert 22 is produced is important because the bend formed by the spine 26 and flap 28 must retain a memory of its flat or planar starting configuration yet allow the flap to readily and evenly fold along the line provided by the score 24. Thus, when the flap is bent it should tend to return to the flat or planar original configuration so that when the flap is restricted from returning to its original completely flat condition it applies a force against the restricting object. When placed in the tube 10 the restricting object will be the inner surface of the tube wall. Because of the combination of the flexibility, shape and material of the flap 28 and the force applied by the bent flap, a seal is formed between the flap 28 and the tube wall 10, FIG. 3. The seal can be improved if the ends of the flap 28 are die cut on an angle to form an edge in the sealing direction of each flap. The angle of the edge formed should match as nearly as possible the inner surface of the periphery of the tube at the point of contact with the angled edge flap 28 of the insert. The seal can also be improved with one or more sonic welds or a complete seal up the tube body.

Figure 3:
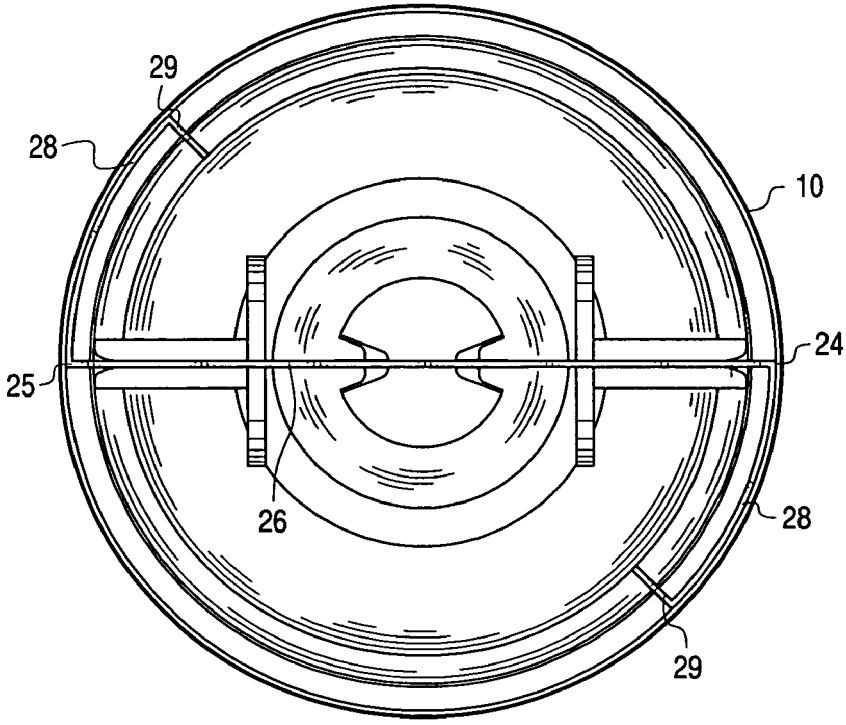
FIG. 3 is an end view along line 3—3 of FIG. 1 of the open tube showing placement of the divider insert within the collar insert.

To further improve the seal formed between the flaps 28 and the inner surface of the tube wall 10, the insert 22 further includes scoring, creases, or folds 25 along the length of the flaps 28 between the outer edges 27 of the insert 22 and flaps 28. The space between outer edge 27 and folds 25 form outer flaps 29. Outer flaps 29 preferably have a smaller width than flaps 28. When folded along folds 25, outer flaps 29 apply further pressure on the flap 28 against the inner wall of tube 10 near fold 25 as shown in FIG. 3. Thus, outer flaps 29 buttress the flaps 28 against the inner surface of tube 10 to ensure separation of the two compartments formed by the presence of insert 22. The outer flaps 29 are such that the ends of flaps 29 are die cut on an angle and preferably do not extend to the bottom of the spine 26. As shown in FIGS. 2 and 7, outer flaps 29 are shorter than the total length of flaps 28 and spine 26. When the outer flaps 29 are bent inwardly along folds or scoring 25, i.e., toward the inside of the tube 10, the outer flaps should tend to return to the original planar configuration. When the outer flaps 29 are restricted from returning to the originally complete flat condition, the flaps 29 apply a force against the resisting object, which would be the contents within the tube. The force against flaps 29 is transferred to the flaps 28, primarily at fold 25, to urge flaps 28 against the inner surface of tube 10.

The flexibility of the flaps 28 and the force provided by the score or fold 24 is important to maintain a seal between the insert 22 and the tube wall during product addition and during and after tube sealing. When a tube is sealed the bottom of the tube is flattened. The insert 22 is always installed into the tube so it will be parallel with the flattened portion at the tube seal 11.

The insert 22 is also designed so that in its full flattened position it is substantially the exact inside dimension of the tube if taken as completely flattened except for the shoulder 12 and neck 14. In this way the positioned insert 22 transforms from a configuration of folded flaps which are force-fitted against a round tube's inner wall to a flattened form at the tube seal 11. A typical commerical tube, when sealed, goes from a round cylinder at the junction with the tube head slowly flattening to being fully flattened at the seal 11. The flaps 28 of the insert 22 go from a maximum bend against a round tube's inner surface to slowly unbending as the tube flattens and the tube walls are the furthest away from each other along seal 11. As mentioned above, the width of flaps 28 may vary and should preferably be sufficiently wide to optimize flap-to-tube wall interaction. The forces resulting from the folds 24 and 25 will maintain pressure against flaps 28 and thereby provide a seal against the tube wall until the insert is fully flat at the tube seal 11. The flexibility of the insert and flap material therefore is important, for in order to maintain a seal while the tube wall flattens out the flaps 28 must twist as it opens up to its full flat width. The flaps must also fold in a configuration so that when the tube is filled the product exerts pressure against the flaps 28 and 29 with the result that increased pressure is exerted so as to optimize the seal of the flaps 28 with the inside wall of the tube.

The overall width of the insert 22, especially at the bottom seal area, must be the same or very nearly the size of the flattened inside of the tube at the sealing area. It is characterized therefore as being about one half the inside circumference of the tube. The insert 22 must seal or crimp between the two inner sides of the flattened tube, and must be made from or coated with material to produce an effective sandwich seal. The seal is therefore made up of three layers which are tube, insert and tube. Laminated and plastic tubes are heat sealed so the insert must be made of material or coated with material that is compatible and will seal with the tube.

The top portion of the insert 22 is die cut to duplicate the shape of the inside of tube head 12, see FIGS. 1, 2, and 7. Insert 22 includes a neck 30 that protrudes into the neck 14 of tube head 12, approximately up to dispensing orifice 15 (FIGS. 1 and 2). Shoulders 32 and 34 on opposite sides of neck 30 are cut on a slant from neck 30 to match the sloping shape of collar 13.

To ensure that insert 22 is held in place at the tube shoulder during product filling, sealing of the tube, and use thereof to dispense the product, there is provided a separate collar insert 36 that includes a neck 38 containing a longitudinal passage 40 therein and a hollow shoulder base 42, see FIGS. 1, 2, and 7. The outer surface 43 of shoulder base 42 of collar insert 36 has the same sloping shape as the inner surface 17 of shoulder 13 of tube head 12. As can be seen from FIG. 4, the bottom edge 44 of hollow shoulder base 42 is circular and has a diameter slightly smaller than the diameter of the bottom of tube head 12 such that the collar insert 36 can be fit within tube head 12 such that the outer shoulder 43 of collar insert 36 is juxtaposed with the inner surface 17 of tube head 12. Likewise, neck 38 concentrically fits within neck 14 of tube head 12 such that the outer surface of neck 38 is juxtaposed with the inner surface of neck 14 of tube head 12. The juxtaposition of collar insert 36 with tube head 10 is particularly shown in FIG. 1. The sizes of the tube head 12 and collar insert 36 are such that the collar insert 36 can be press fitted within the tube head 12 without the need for an adhesive. An adhesive can be used to secure collar insert 36 to tube head 12 if desired.

Figure 4:
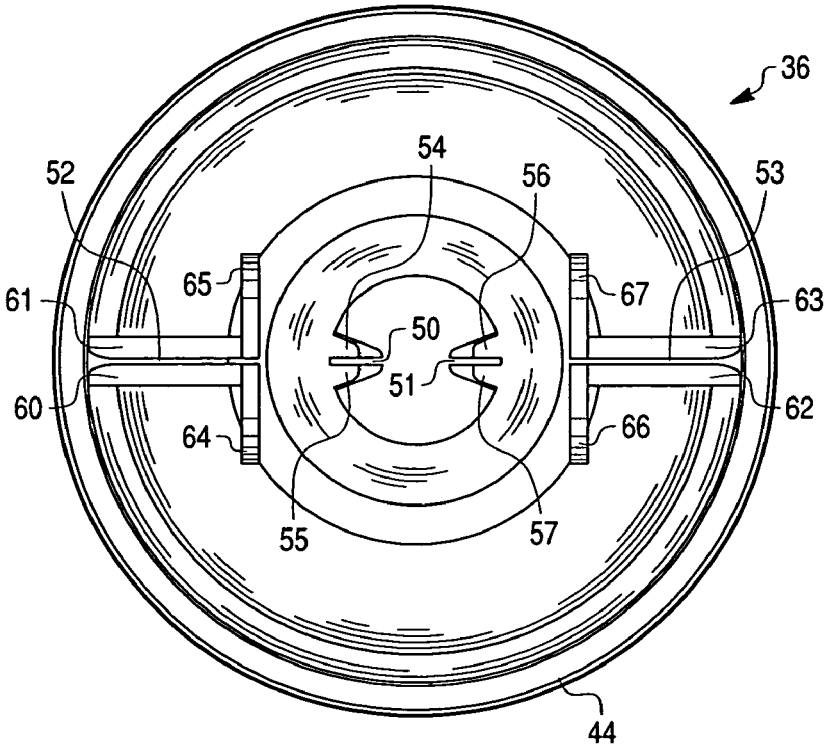
FIG. 4 is a bottom end view of the collar insert prior to insertion of the partition.

As shown in FIG. 4, the collar insert 36 contains two sets of opposing slots, one set 50 and 51, within the neck 38 of collar insert 36, and a second set, 52 and 53, within shoulder base 42 of collar insert 36. Slots 50 and 51 are formed in the space between two sets of spaced protrusions 54, 55 and 56, 57 as shown in FIGS. 2 and 4. Slots 50 and 51 extend longitudinally substantially through neck 38 from the top of shoulder base 42 to the top portion of neck 38, see FIG. 2. Thus, when insert 22 is placed within the tube, the opposite sides of neck portion 30 are supported within the respective slots 50 and 51, substantially through the entire length of neck 30. Slots 50 and 51 are placed at an angle of 180° to each other on opposite sides of passage 40 in collar insert 36.

Figure 5:
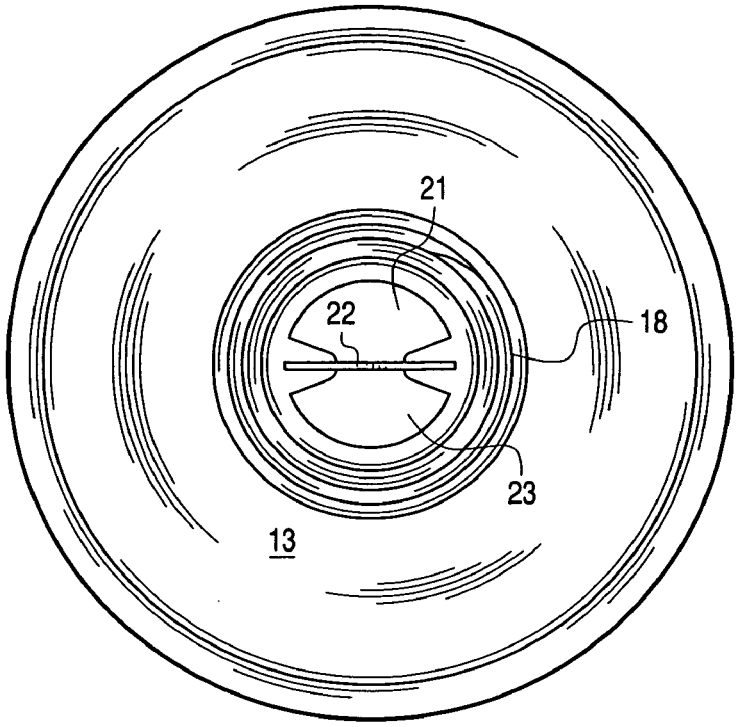
FIG. 5 is a top view of the tube with the partition and collar insert fit within the tube head.
Figure 6:
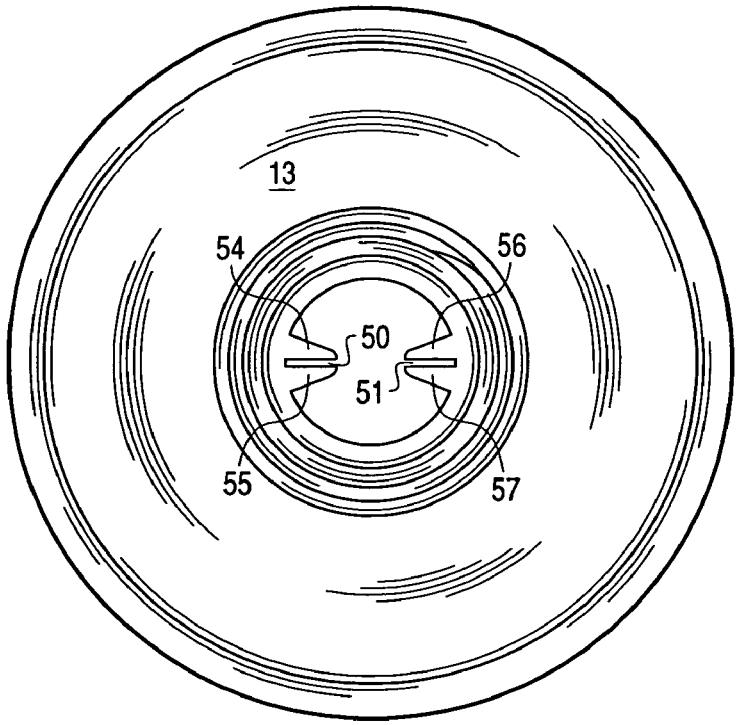
FIG. 6 is a top view of the tube with the collar insert fit within the tube head without the partition.

Collar insert 36 also contains slots 52 and 53 formed between two sets of spaced protrusions 60, 61 and 62, 63, respectively, on the underside of collar base 42. Slots 52 and 53 are placed at an angle of 180° from each other again, on opposite sides of passage 40. Slots 52 and 53 extend almost from the outer edge of shoulder base 42 to a location spaced from the outer edge of passage 40. When insert 22 is placed within the tube 10, the shoulder portions 32 and 34 of insert 22 are placed within respective slots 52 and 53. Two sets of spaced protrusions 64,65 and 66,67, are also placed on the underside of shoulder base 42, and extend at a 90° angle from protrusions 60, 61 and 62, 63. The space between protrusions 64, 65 forms continuous slot 52 with the space between protrusions 60, 61, and the space between protrusions 66, 67 forms continuous slot 53 with the space between protrusions 62,63. Protrusions 64, 65 and 66, 67 are spaced from passage 40 and when insert 22 is placed within the tube, protrusions 64, 65 and 66, 67 will abut the respective upwardly inclining edges 70 and 71 on the respective shoulder portions 32 and 34 of insert 22. From FIG. 3, it can be seen how the insert 22 fits within the respective slots 52 and 53, contained within shoulder base 42 and slots 50 and 51 within neck portion 38 of collar insert 36. FIGS. 5 and 6 illustrate a top view of the tube and show the collar insert 36 juxtaposed to the tube head 12 with slots 50 and 51 extending near the orifice opening 15. The neck portion 30 of insert 22 extends within the slots 50 and 51 as shown, in particular, in FIG. 5. The collar insert 36 ensures that the insert 22 remains stationary within the tube while the tube is being filled, sealed, and used. It is important in many circumstances that the insert not move from its center line orientation across the tube during use so that equal parts of the contents of tube 10 are dispensed through orifice 15. Collar insert 36 is preferably molded in one piece to form neck 38, collar base 42, and the spaced protrusions to form slots 50, 51 and 52, 53.

One important advantage to having the collar insert is that it can act as a product/package barrier. This barrier can act as a flavor, fragrance, alcohol or other volatile ingredient barrier. The insert can be made from any material. In a preferred embodiment the collar insert is fabricated from polybutylene terephthalate (PBT), in particular Velox 215 HPR manufactured by General Electric Plastics.

In accordance with the invention, a plurality of embodiments are also contemplated which provide chemical and/or mechanical seal-means in addition to the basic pressure seal 11. For example, heat or sonic means may seal the insert 22 or any part thereof to tube 10 from the outside of the tube, without effecting the integrity or appearance of the tube or the contents therein. In addition, non-contaminating materials can be put onto the edges of the finished insert which will improve the seal between the insert and the inner surface of the tube when inserted into said tube. This chemical and/or mechanical seal enhancement can be accomplished in several different ways:

i) Use of an appropriate adhesive and/or caulking type material which is applied to the edges of the insert.

ii) A polymeric type material which is applied to the cut edges of the insert and which swells and becomes tacky when contacted by water or moisture contained in the product thereby forming the desired seal. The polymer is chosen based on its speed of swelling, tackiness and insolubility, so that it sets rapidly, remains in place and does not contaminate the product.

iii) Another embodiment which serves to improve the sealing of the partition forming inserts utilizes a suitable polymeric material to help seal the edges as described above except the polymer is applied to the board before it is coated or laminated with a polymeric material as hereinbefore described. The sealing polymer is only exposed at the edges of the insert member once the board is coated or laminated and then die cut. Only where the cut edge, i.e., the sealing edge, of the board is exposed to product moisture does the polymer swell. Consequently, this system only forms a seal at the edge of the insert if moisture from the product contacts it. If the product does not migrate and reach an exposed edge due to effective pressure sealing, then the area is not in need of additional sealing. As the filled tube is used by consumers, if a slight shift of the insert or a change in the tube's shape weakens a seal, the insert provides in situ polymer where needed to continuously reform seals.

iv) The present invention provides still another embodiment which can be utilized. This embodiment die cuts the insert before the polycoating or lamination step and then laminates both sides of the insert with a precut polymeric film or sheet or other tube sealing compatible film. The film to be laminated over the already die cut board should be patterned as exactly as possible to the outline of the flat insert except that it should overlap by a short distance, such as about one eighth inch, around the entire periphery of the flat insert. The insert would be laminated front and back with this cut and thus patterned sheet material. Where the front and back polymeric sheets overlap the board they are sealed to each other. Where the two sheets seal to each other they form a flexible gasket entirely around the edge or periphery of the insert. When inserted into the tube, such gasket provides improved sealing with essentially every surface the insert contacts once installed into the tube.

In view of the collar insert 36 which contains respective slots 50, 51, 52, and 53, the need for an adhesive as described immediately above is not required to provide the separate tube compartments and maintain the shape and size of the separate compartments during filling, sealing, or using the tube to dispense product.

In accordance with the present invention, a method for assembling the dual-compartment dispensing tube assembly comprises placing the tube 10, with tube head 12 already attached thereto, on a filling line in an indexed position suitable for filling and sealing. Insert 22 is then placed within the collar insert 36 such that neck 30 is fit within slots 50 and 51 and shoulders 32 and 34 are fit within slots 52 and 53. The assembly of insert 22 and collar insert 36 is then directed into and through the filling end of the tube 10 until the collar base 40 of collar insert 36 is press fit within the tube head 12 such that outer shoulder 43 of collar insert 36 is juxtaposed with the interior surface 17 of tube head 12. The insert 22 is directed in such a manner so that the spine and flaps are folded generally into a "Z" shape so as to provide a partition which divides the tube into two compartments. Each of the compartments are filled and the filling end of the tube is sealed by heat, crimping or the like to form a straight line seal with planar insert.

While particular embodiments of the present invention have been illustrated and described, it will be obvious to those skilled in the art that various changes and modifications can be made without departing from the spirit and scope of the invention and it is intended to cover in the appended claims all such changes and modifications that are within the scope of this invention.

What is claimed is:

1. A substantially planar partition-forming member suitable for insertion into a dispensing tube having a dispensing end with affixed thereto a shoulder and a neck terminating as a dispensing orifice and adapted to receive a closing cap and an open filling end into which the partition-forming member is inserted prior to filling to form a partition and two separate and discrete compartments within the tube; said partition-forming member having a configuration comprising:

(i) an end portion having a neck, (ii) an adjacent portion to said neck sloping downward from each side of said neck so as to conform to the shape of the tube shoulder, (iii) a mid-portion for extending within the tube, (iv) a terminal end, said partition-forming member being first folded along each longitudinal side below said adjacent portion (ii) at a distance from respective outer edges thereof thereby providing a spine between the first folds and two sealing flaps adjacent thereto;

said partition-forming member being further folded along each longitudinal side below said adjacent portion (ii) at a distance between the first folds and respective outer edges to form two spaced outer flaps;

said partition-forming member being comprised of a material sufficiently resilient that such member tends to revert to its original planar configuration thereby causing pressure of the flaps against the inner surface of the tube.

2. The partition-forming member of claim 1 wherein said member is die cut.

3. The partition-forming member of claim 1 wherein said member is comprised of a material which is bondable with a surface of the tube.

4. The partition-forming member of claim 1 wherein said member is formed from plastic sheet material, board material coated with a polymeric material, or a combination thereof.

5. The partition-forming member of claim 4, wherein said member comprises an inner layer of a board material and two outer layers of polymeric sheet material, the total planar dimensions of said polymeric sheets being greater than those of the paper board thereby resulting in a polymeric sheet to polymeric sheet overlapping in a plane with and around the edge of said member and said overlapping of sheets being laminated together to form a flexible sealing gasket in a plane with and around the edge of said member.

6. The partition-forming member of claim 1 wherein the edges of the sealing flaps are cut at an angle to form a biased surface in the sealing direction of each flap.

7. The partition-forming member of claim 1 wherein the outer flaps have a width less than said sealing flaps.

8. The partition-forming member of claim 1 wherein said outer flaps extend from below said adjacent portion (ii) to above said terminal end (iv).

9. The partition-forming member of claim 1 wherein said sealing flaps are folded in opposite directions from each other relative to said spine so as to form a Z-shape with said spine.

10. A dual compartment dispensing tube assembly, comprising:

(a) a tubular container body having a dispensing end in the form of a tube head having a shoulder and a neck terminating as a dispensing orifice and adapted to receive a closing cap, and a filling end which is sealed after contents are placed in said compartments;

(b) a collar insert placed in said container body and juxtaposed to said tube head, said collar insert containing a hollow shoulder base juxtaposed to said shoulder, and a neck concentrically juxtaposed to said neck of said tube head and including a passage therethrough, said collar insert containing slots to receive a partition-forming insert;

(c) a substantially planar partition-forming insert positioned in said slots and extending into said tubular container body to provide two adjacent compartments defined by a common wall segment and a pair of outer arcuate walls;

said planar insert having a configuration generally conforming to that of the tube if flattened and comprising (i) an end portion which is substantially equal to the inner diameter of the neck of said collar insert and which extends through the passage formed in the neck of said collar insert, (ii) an adjacent portion conforming to the inside shape of the shoulder of said collar insert, (iii) a mid-portion extending axially within the tube and having a width of at least about one half the inner circumference of the tube, and (iv) a terminal end positioned within the filling end of the tube and having a width substantially equal to one half the inner-circumference of said tube;

said planar insert being folded along each longitudinal side to provide a spine between the folds and a flap at either side of the folds, wherein said insert can be folded generally into a "Z" shape, and said planar insert being comprised of a material sufficiently resilient such that the insert tends to revert to its original planar configuration thereby causing pressure of the flaps against the inner arcuate walls thereby providing a pressure seal along the longitudinal edges with the surface of said arcuate walls.

11. The assembly of claim 10 wherein the planar insert is comprised of a material which is bondable with a surface of the tubular container body.

12. The assembly of claim 10 wherein said planar insert is die cut.

13. The assembly of claim 10 wherein said planar insert is formed from plastic sheet material, board material coated with a polymeric material, or a combination thereof.

14. The assembly of claim 13, wherein said planar insert comprises an inner layer of board material and two outer layers of polymeric sheet material, the total planar dimensions of said polymeric sheets being greater than these of the board, thereby resulting in a sheet to sheet overlapping in a plane with and around the edge of said insert and said overlapping of sheets being laminated together to form a flexible sealing gasket in a plane with and around the edge of said insert.

15. The assembly of claim 10 wherein the edges of the flaps are cut at an angle to form a biased surface in the sealing direction of each flap.

16. The assembly of claim 10 wherein the tubular body is an extended tubular cylinder comprised of thermoplastic material, aluminum, or a laminated combination of at least two materials from any one or more of the above materials.

17. The assembly of claim 10 wherein, after filling, the filling end is sealed to form a straight line seal at said filling end with said planar partition-forming insert.

18. The assembly of claim 10 wherein the tubular container body has a cross-section which is a circle or an ellipsoid.

19. The assembly of claim 10 wherein said collar insert includes a pair of opposing slots in the neck of said collar insert, said neck of said planar insert being held within said slots.

20. The assembly of claim 10 wherein said collar insert includes a pair of slots in said hollow shoulder on each side of said neck, said adjacent portion (ii) of said planar insert being held within said slots.

21. The assembly of claim 10 wherein said collar insert is formed from PBT.

* * * * *